US005496170A

United States Patent [19]

Primdahl et al.

[11] Patent Number: 5,496,170

[45] Date of Patent: Mar. 5, 1996

[54] SWIRLING-FLOW BURNER

[75] Inventors: Ivar I. Primdahl; Thomas S. Christensen, both of Copenhagen; Lise Olsen, Askeby, all of Denmark

[73] Assignee: Haldor Topsøe A/S, Denmark

[21] Appl. No.: 309,346

[22] Filed: Jul. 8, 1994

Related U.S. Application Data

[63] Continuation of Ser. No. 986,975, Dec. 7, 1992.

[30] Foreign Application Priority Data

Dec. 6, 1991 [DK] Denmark ..... 1974/91

[51] Int. Cl.[6] ..... F23C 7/00; F23C 9/00

[52] U.S. Cl. ..... 431/187; 431/9; 431/181; 239/403; 239/416.5; 239/424

[58] Field of Search ..... 431/9, 10, 181, 431/187, 7, 190; 239/416.5, 416.4, 424, 425.5, 403, 404, 406, 400, 402

[56] References Cited

U.S. PATENT DOCUMENTS

| | | | |
|---|---|---|---|
| 903,736 | 11/1908 | Lee | 239/400 |
| 1,404,429 | 1/1922 | Buell et al. | 239/416.4 |
| 1,460,130 | 6/1923 | Hofmann | 239/416.4 |
| 1,763,387 | 6/1930 | Beach | 239/406 X |
| 2,772,729 | 5/1951 | Mayhew . | |
| 3,685,741 | 8/1972 | O'Sickey | 60/742 X |
| 3,915,387 | 10/1975 | Caruel et al. | 60/737 X |
| 3,980,233 | 9/1976 | Simmons et al. | 239/424 X |
| 4,139,157 | 2/1979 | Simmons | 239/404 X |
| 4,443,228 | 4/1984 | Schlinger | 239/424 X |
| 4,773,596 | 9/1988 | Wright et al. . | |
| 5,014,918 | 5/1991 | Halvorsen | 60/740 X |
| 5,020,329 | 6/1991 | Ekstedt et al. | 60/737 |

FOREIGN PATENT DOCUMENTS

| | | | |
|---|---|---|---|
| 2133126 | 1/1973 | Germany | 239/403 |

*Primary Examiner*—Carl D. Price
*Attorney, Agent, or Firm*—Ostrolenk, Faber, Gerb & Soffen

[57] ABSTRACT

Swirling-flow burner with improved design comprising U-shaped oxidizer and fuel gas injectors arranged coaxially at the burner face. The burner is further equipped with a bluff-body with static swirler blades extending inside the oxidizer injector.

5 Claims, 1 Drawing Sheet

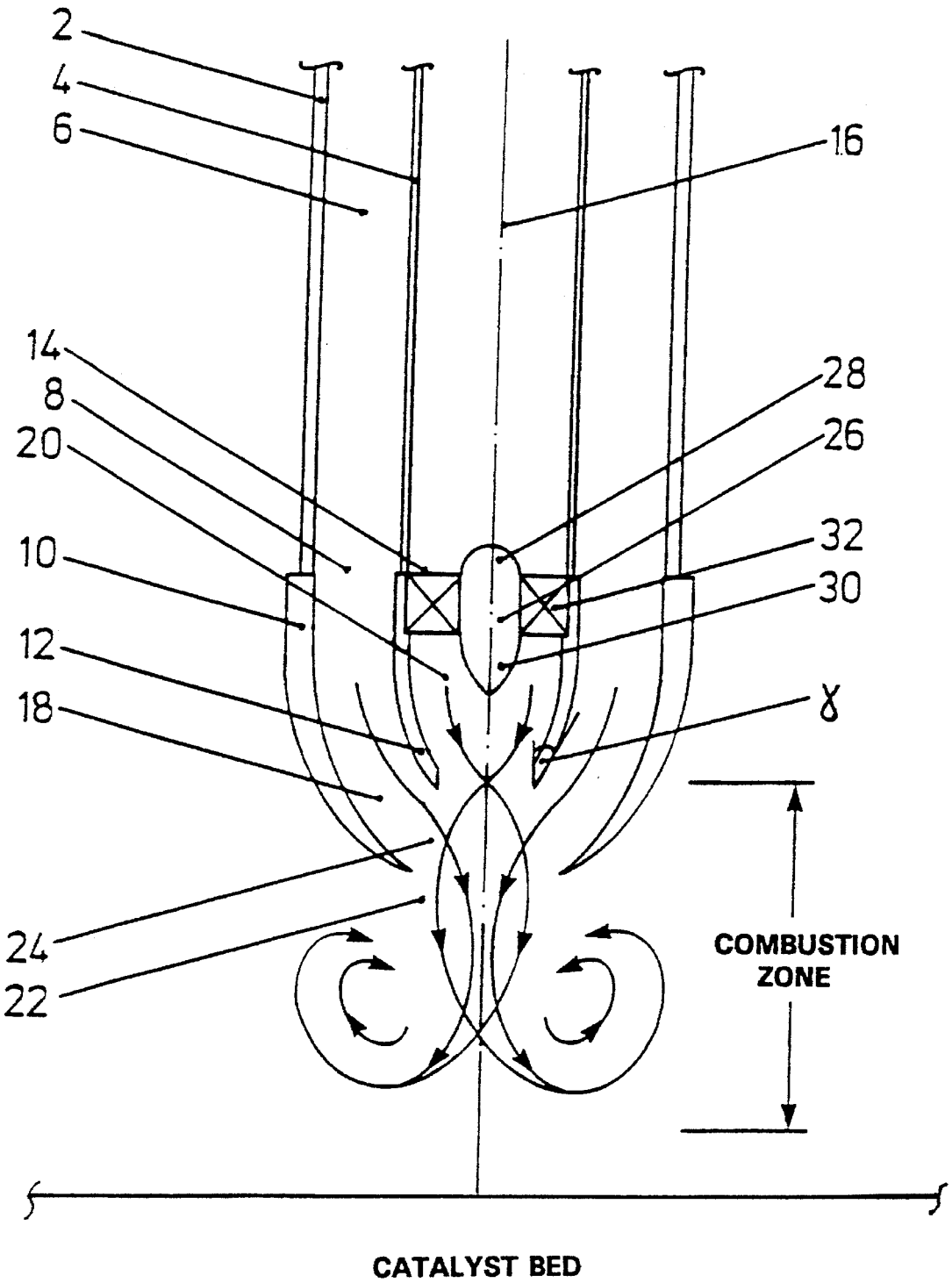
2
4
6
16
14
8
20
10
12
18
24
22
28
26
32
30
γ
COMBUSTION ZONE
CATALYST BED

SWIRLING-FLOW BURNER

This is a continuation of application Ser. No. 07/986,975, filed on Dec. 7, 1992.

BACKGROUND OF THE INVENTION

1. Field of the Invention

The present invention relates to a swirling-flow burner with separate fuel and oxidizer supply, in particular, to a swirling-flow burner for use in gas-fuelled combustion reactors.

2. Description of the Prior Art

Burners of the swirling flow type are mainly used for firing gas-fuelled industrial furnaces and process heaters, which require a stable flame with high combustion intensities. Conventionally designed swirling-flow burners include a burner tube with a central tube for fuel supply surrounded by an oxidizer supply port. Intensive mixing of fuel and oxidizer in a combustion zone is achieved by passing the oxidizer through a swirler installed at the burner face on the central tube. The stream of oxidizer is, thereby, given a swirling-flow, which provides a high degree of internal and external recirculation of combustion products and thus a high combustion intensity.

As a general drawback of conventional swirling-flow burners of the above design, the burner face is at high gas flow velocities, as required for industrial burners of this design, exposed to overheating caused by the high degree of internal recirculation along the central axis of the combustion zone. Hot combustion products flow, thereby, back towards the burner face, which results in rapid heating up to high temperatures and, consequently, destruction of the face.

SUMMARY OF THE INVENTION

The general object of this invention is to eliminate this problem by an improved design of the burner face in the known swirling-flow burners.

This improved design is based on the observation that a stable flame with high combustion intensity and without detrimental internal recirculation of hot combustion products, is obtained when providing a swirling-flow of oxidizer with an overall flow direction concentrated along the axis of the combustion zone and at the same time directing the fuel gas flow towards the same axis.

In accordance with this observation, the swirling-flow burner of this invention comprises a burner tube and a central oxidizer supply tube concentric with and spaced from the burner tube, thereby defining an annular fuel gas channel between the tubes, the oxidizer supply tube and the fuel gas channel having separate inlet ends and separate outlet ends.

A fuel gas injector is connected to the outlet end of the fuel gas channel. The fuel gas injector having a U-shaped cross sectional inner surface around a common axis of the burner tube and the injector.

An oxidizer injector is connected to the outlet end of the oxidizer supply tube. The oxidizer injector having a U-shaped cross sectional surface coaxially with and spaced from the fuel gas injector.

A fuel gas injection chamber is defined between the surfaces of the fuel gas and oxidizer injector and an oxidizer injection chamber is defined within the surface of the oxidizer injector.

Each of the injection chambers, having a U-shaped contour and being provided with a circular outlet end around the common axis.

A cylindrical bluff-body is coaxially arranged within the oxidizer injection chamber, the bluff-body having a dome-shaped upstream end and a tapered downstream end; and a swirler is installed on the bluff-body between its upstream end and its downstream end, the swirler having static swirler blades extending to the surface of the oxidizer injection chamber.

As a result of the above-described swirling-flow burner, the oxidizer supplied to the oxidizer injection chamber is injected into a downstream combustion zone in a swirling-flow by combined action of the bluff-body and the swirler. The oxidizer flow is directed around a common axis of the injection chambers and the combustion zone after having passed through the oxidizer injection chamber;

the oxidizer is mixed in the combustion zone with fuel gas being supplied to the fuel gas injection chamber and injected into the combustion zone in an inwardly flow direction towards the axis of the combustion zone after having passed through the fuel gas injection chamber.

The swirling-flow induced in the swirler promotes mixing of fuel gas and oxidizer by increasing the area of their contact. Effective mixing is obtained, when adjusting the pitch angle of the swirler blades to an angle of between 15° and 75°, preferably between 20° and 45°.

At the same time, the inwardly directed flow pattern along the axis of the combustion zone caused by the U-shaped contours of the injection chamber prevents recirculation of hot combustion products in the high temperature region around the axis of the combustion zone, which otherwise would lead to overheating of the burner face.

Furthermore, the inwardly directed flow pattern leads to a high degree of external recirculation in the low temperature outer region of the combustion zone. From this region only cooled combustion products flow back to the burner face, where the products are being sucked into the hot combustion zone area and reheated there.

During use of the burner according to the invention in gas fired reactors, the recycle stream of cooled combustion products protects advantageously the reactor walls surrounding the combustion zone against impingement of hot combustion products and prolongs the lifetime of the reactor.

The temperature at the burner face close to the outlet end of the injection chambers may further be lowered by forming the oxidizer injector at the outlet end of the oxidizer injection chamber sharp-edged with a minimum tip angle. Reduced heating and suitable mechanical strength of the injector are obtained at tip angles of between 15° and 60°, preferably between 15° and 40°.

As a further advantage of the burner according to the invention, the high degree of external recirculation of cooled combustion products provides a homogeneous temperature distribution in the combustion outlet zone.

This is of great importance during operation of fired catalytic reactors, where the product yield highly depends on the temperature distribution in the catalyst bed, which typically is arranged in the combustion outlet zone.

Accordingly, the burner of this invention is particularly useful in heating and carrying out catalytic processes in gas-fuelled reactors.

BRIEF DESCRIPTION OF THE DRAWING

The above objects and advantages of the invention are more fully described in the following description by reference to the drawing, in which the sole Figure shows schematically a sectional view of a swirling-flow burner according to a specific embodiment of the invention.

DETAILED DESCRIPTION OF THE PREFERRED EMBODIMENT

In FIG. 1, a burner tube 2 surrounds coaxially to common axis 16 a central oxidizer supply tube 4, defining a fuel gas supply channel 6 between the tubes.

An injector 10 having a continuously curving wall with a U-shaped cross sectional inner surface around axis 16 is installed at outlet end 8 of burner tube 2. Injector 10 accommodates a coaxial injector 12 also having a continuously curving wall with a U-shaped cross sectional surface mounted on the outlet end 14 of central tube 4.

The U-shaped injector form may conveniently be obtained by machining a suitable metallic body having a cylindrical part and a conical part. The transition angle between the cylindrical and conical part is thereby preferably in the range of 115° to 170°.

The surfaces of injectors 10 and 12 enclose a fuel gas injection chamber 18 communicating with the fuel gas supply channel 6, and within injector 12 an oxidizer injection chamber 20, at the outlet end of central tube 4. Injection chambers 18 and 20 have U-shaped contours around axis 16, narrowing toward circular outlet ends 22 and 24 coaxially arranged to axis 16. Outlet end 24 of injection chamber 20 may open into the lower part of injection chamber 18.

The edge of injector 12 surrounding the outlet end of the oxidizer injection chamber 20 is tapered with a minimum tip angle $\gamma$ in order to protect the edge against overheating as described in more detail below.

Injection chamber 20 is further equipped with a cylindrical bluff-body 26 coaxially spaced to the inner surface of chamber 20. Bluff-body 26 is provided with domeshaped upstream end 28 and tapered downstream end 30. Around the cylindrical surface of bluff-body 26 a swirler 32 is installed with static swirler blades (not shown) extending to the surface of injection chamber 20.

In operating the burner with the above design, fuel gas is supplied through channel 6 to injection chamber 18 and injected into a combustion zone downstream to outlet end 24 of injection chamber 20. By means of the U-shaped contour of injection chamber 18 the injected stream of fuel gas is in the combustion zone directed towards the common axis 16 of injection chamber 18 and the combustion zone as indicated by arrows in the Figure. In the combustion zone the fuel gas stream is mixed with oxidizer supplied in central tube 4 and injected into the combustion zone through injection chamber 20.

Before being injected into the combustion zone the oxidizer stream is brought into swirling-flow by passage through swirler 32. Furthermore, by means of bluff-body 26 and the U-shaped contour of injection chamber 20, the swirling oxidizer stream is discharged into the combustion zone in an overall flow directed around the axis of the combustion zone.

As a result, mixing of the oxidizer and fuel gas stream is mainly accomplished in the high temperature region around the axis of combustion zone. Thereby, deleterious internal recirculation of hot combustion products within this region is prevented. Recirculation is only established in the low temperature outer region of the combustion zone, resulting in reduced material temperatures close to the outlet ends of the injection chambers. As mentioned hereinbefore, the temperature in this region may further be controlled by angle $\gamma$ of the oxidizer injector edge around the outlet end of the oxidizer injection chamber 20, whereby the mixing zone of oxidizer and fuel gas is kept at an increasing distance from the edge at decreasing tip angles.

Having thus described the invention with reference to a specific embodiment thereof, changes and alternations, which will readily be apparent to those skilled in the art, are contemplated as within the scope of the invention. For example, in applications requiring very high combustion intensities the burner face may further be protected against high temperatures by addition of an inert gas or steam in the region of the outlet ends of injection chambers 18 and 20 introduced at the edge of injector 12 through a bored channel within oxidizer injector 12.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. A swirling-flow burner comprising:

an outer, peripheral burner tube;

a central oxidizer supply tube concentric with and spaced from the burner tube, defining an outer annular fuel gas channel between the tubes, the oxidizer supply tube and the fuel gas channel having separate inlet ends and separate outlet ends;

a fuel gas injector connected to the outlet end of the fuel gas channel, said fuel gas injector having a wall with a U-shaped cross sectional inner surface around a common axis of the burner tube and the injector and having a circular outlet end around the common axis, said U-shaped cross sectional inner surface narrowing toward said circular outlet end, for providing an unobstructed flow of fuel injected toward the common axis of the fuel gas injector;

a central oxidizer injector connected to the outlet end of the central oxidizer supply tube, said oxidizer injector having a wall with a U-shaped cross sectional surface coaxial with and spaced from said fuel gas injector, said oxidizer injector having a circular and sharp-edged outlet end around the common axis, the sharp edge being formed by inner and outer surfaces of the oxidizer injector meeting to form a tip, the sharp edge having a tip angle of between 15° and 60° between the inner and outer surfaces, taken at the tip, which outlet end of the oxidizer injector is recessed from the outlet end of the fuel gas injector, said cross sectional surface narrowing toward said circular outlet end of said oxidizer injector;

a cylindrical bluff-body coaxially arranged within the oxidizer injection chamber, the bluff-body having a domeshaped upstream end and a tapered downstream end; and a swirler installed on the bluff-body between its upstream end and its downstream end, the swirler having static swirler blades extending to the surface of the oxidizer injector;

whereby oxidizer supplied to the oxidizer injector is injected into a downstream combustion zone in a swirling flow by means of the bluff-body and the swirler, which oxidizer flow is directed around the common axis of the injectors and the combustion zone after having passed through the oxidizer injector;

the oxidizer is mixed in a high temperature inner region of the combustion zone with fuel gas being supplied to the fuel gas injector and injected into the combustion zone in an inwardly flow direction towards the common axis of the combustion zone after having passed through the fuel gas injector; and combustion products in a low temperature outer region of the combustion zone having an external, recirculation flow direction.

2. The swirling-flow burner of claim 1, wherein the swirler blades are arranged in the swirler such that the swirler blades have a pitch angle of 15°–75° with respect to a plane containing the common axis.

3. The swirling-flow burner of claim 2, wherein the pitch angle is in the range of 20°–45°.

4. The swirling-flow burner of claim 1, wherein the tip angle is in the range of 15°–40°.

5. The swirling-flow burner of claim 1, wherein said fuel gas injector and said oxidizer injector each are formed by machining a metallic body having a cylindrical part having an outer surface and a conical part having an outer surface, a transition angle between said outer surface of said cylindrical part and said outer surface of said conical part taken in a plane containing said common axis being in the range of 115° to 170°.

* * * * *